US007870647B2

(12) United States Patent
Steurer

(10) Patent No.: US 7,870,647 B2
(45) Date of Patent: Jan. 18, 2011

(54) METHODS AND APPARATUS FOR ASSEMBLING A DOOR HANDLE ASSEMBLY

(75) Inventor: Brian Michael Steurer, Louisville, KY (US)

(73) Assignee: General Electric Company, Schenectady, NY (US)

( * ) Notice: Subject to any disclaimer, the term of this patent is extended or adjusted under 35 U.S.C. 154(b) by 59 days.

(21) Appl. No.: 11/077,730

(22) Filed: Mar. 11, 2005

(65) Prior Publication Data

US 2006/0200948 A1 Sep. 14, 2006

(51) Int. Cl.

| | |
|---|---|
| ***A45C 13/22*** | (2006.01) |
| ***A45C 13/26*** | (2006.01) |
| ***A45C 3/00*** | (2006.01) |
| ***A63C 17/01*** | (2006.01) |
| ***E05B 3/00*** | (2006.01) |
| ***A47B 96/06*** | (2006.01) |
| ***A47B 96/04*** | (2006.01) |

(52) U.S. Cl. ..... 16/412; 16/440; 16/111.1; 16/111 R; 16/436; 292/336.3; 248/220.21; 312/405

(58) Field of Classification Search ..... 16/412, 16/111.1, 110.1, 436, 413, 422, 415, 440, 16/111 R, 114 R, DIG. 18, DIG. 19, DIG. 24, 16/DIG. 25; 292/336.3, DIG. 53, DIG. 54, 292/DIG. 71; 248/220.21; 312/405, 244
See application file for complete search history.

(56) References Cited

U.S. PATENT DOCUMENTS

| | | | | |
|---|---|---|---|---|
| 2,001,666 | A * | 5/1935 | Keil | 16/444 |
| 2,203,413 | A * | 6/1940 | Hood | 297/411.21 |
| 2,459,658 | A * | 1/1949 | Klein | 16/413 |
| 2,882,549 | A * | 4/1959 | Strauss | 16/412 |
| 4,404,709 | A * | 9/1983 | Janz et al. | 16/444 |
| 4,540,207 | A * | 9/1985 | Klasen et al. | 292/341.17 |
| 4,926,523 | A | 5/1990 | Carlson et al. | |
| 5,303,451 | A | 4/1994 | Graviss et al. | |
| 5,358,326 | A | 10/1994 | Cherry et al. | |
| 5,412,839 | A | 5/1995 | McCollom | |
| 5,675,867 | A * | 10/1997 | Howie, Jr. | 16/412 |
| 5,740,587 | A * | 4/1998 | Onai et al. | 16/412 |
| 5,797,164 | A * | 8/1998 | Donaghy | 16/412 |
| 6,473,939 | B1 * | 11/2002 | Stegmaier | 16/436 |
| 6,546,597 | B2 | 4/2003 | Atalla et al. | |
| 6,629,339 | B2 * | 10/2003 | Pohl et al. | 16/436 |
| 6,871,385 | B2 * | 3/2005 | Wing et al. | 16/436 |
| 2006/0207062 | A1 * | 9/2006 | Wing | 16/412 |

* cited by examiner

*Primary Examiner*—David Reese
(74) *Attorney, Agent, or Firm*—George L. Rideout, Esq.; Armstrong Teasdale LLP

(57) ABSTRACT

A handle assembly includes a handle body including a handle body having at least one attachment portion proximate a respective end of the handle body, wherein the at least one attachment portion is configured to engage a door panel. At least one latch member is coupled to a respective one of the at least one attachment portion, and the at least one latch member is configured to attach the at least one attachment portion to the door panel. At least one protective member is coupled to a respective one of the at least one attachment portion. The at least one protective member facilitates reducing damage to the door panel during installation of the handle assembly to the door panel.

11 Claims, 2 Drawing Sheets

METHODS AND APPARATUS FOR ASSEMBLING A DOOR HANDLE ASSEMBLY

BACKGROUND OF THE INVENTION

This invention relates generally to home appliances, and more particularly, to methods and apparatus for assembling a handle assembly with a home appliance.

Known home appliances, such as refrigerators, generally include a housing defining at least one compartment for storage of food items, and at least one door for accessing the compartment. A handle is typically coupled to an exterior surface of the door for accessing the compartments. In at least some known appliances, fasteners are used to fasten the handle to the door by extending the fasteners through the door from the inside of the door. This known type of construction is a reliable method of coupling handles to the door. However, in at least some known appliances, this type of mounting method is not feasible or is undesirable. For example, in home appliances utilizing a foam in place construction for the door, the fasteners typically do not extend through the inside portion of the door. Additionally, it may be undesirable to a consumer if the fasteners are visible from either side of the door. Moreover, the mounting method of extending fasteners through the door typically provides a gap between the handle and the door after assembly which may be visible to the consumer.

As a result, at least some known appliances have been developed which utilize sliding ramp components coupled to an exterior of the door, wherein the handle is vertically mounted to the ramp components using a sliding motion. However, during the process of engaging the ramp components, the sliding motion can cause marring and/or scratching, especially on a high gloss door. This marring or scratching is visible by the consumer and highly undesirable. Moreover, these known appliances utilizing the ramp components for mounting the handle typically require a large pull in force to fully mount the handle to the door, and to minimize the gap between the handle and the door.

BRIEF DESCRIPTION OF THE INVENTION

In one aspect, a handle assembly is provided. The handle assembly includes a handle body including a handle body having at least one attachment portion proximate a respective end of the handle body, wherein the at least one attachment portion is configured to engage a door panel. At least one latch member is coupled to a respective one of the at least one attachment portion, and the at least one latch member is configured to attach the at least one attachment portion to the door panel. At least one protective member is coupled to a respective one of the at least one attachment portion. The at least one protective member facilitates reducing damage to the door panel during installation of the handle assembly to the door panel.

In another aspect, a home appliance is provided. The home appliance includes a housing defining at least one compartment therein, at least one door for accessing the compartment, and a door handle assembly coupled to the door. The door handle assembly includes a handle body having a first attachment portion for attaching a first end of the handle body to the door, and a second attachment portion for attaching an opposing second end of the handle body to the door. The door handle assembly further includes a first latch member coupled to the first attachment portion, and a second latch member coupled to the second attachment portion, wherein the latch members are configured to engage the door for securing the handle body to the door. The door handle assembly also includes a first protective member coupled to the first attachment portion, and a second protective member coupled to the second attachment portion, wherein the protective members facilitate reducing damage to the door during installation of the handle assembly to the door.

In still another aspect, a method of assembling an appliance is provided, wherein the appliance includes a door having at least one mounting flange extending from an exterior surface of the door, and a door handle assembly having at least one latch member and at least one mounting surface. The method includes securely coupling the at least one latch member to the door handle assembly, and coupling a protective member to each mounting surface of the door handle assembly. The method also includes engaging the at least one latch member with the at least one mounting flange of the door such that only the protective members contact the exterior surface of the door during installation of the door handle assembly.

DETAILED DESCRIPTION OF THE INVENTION

Figure 1:
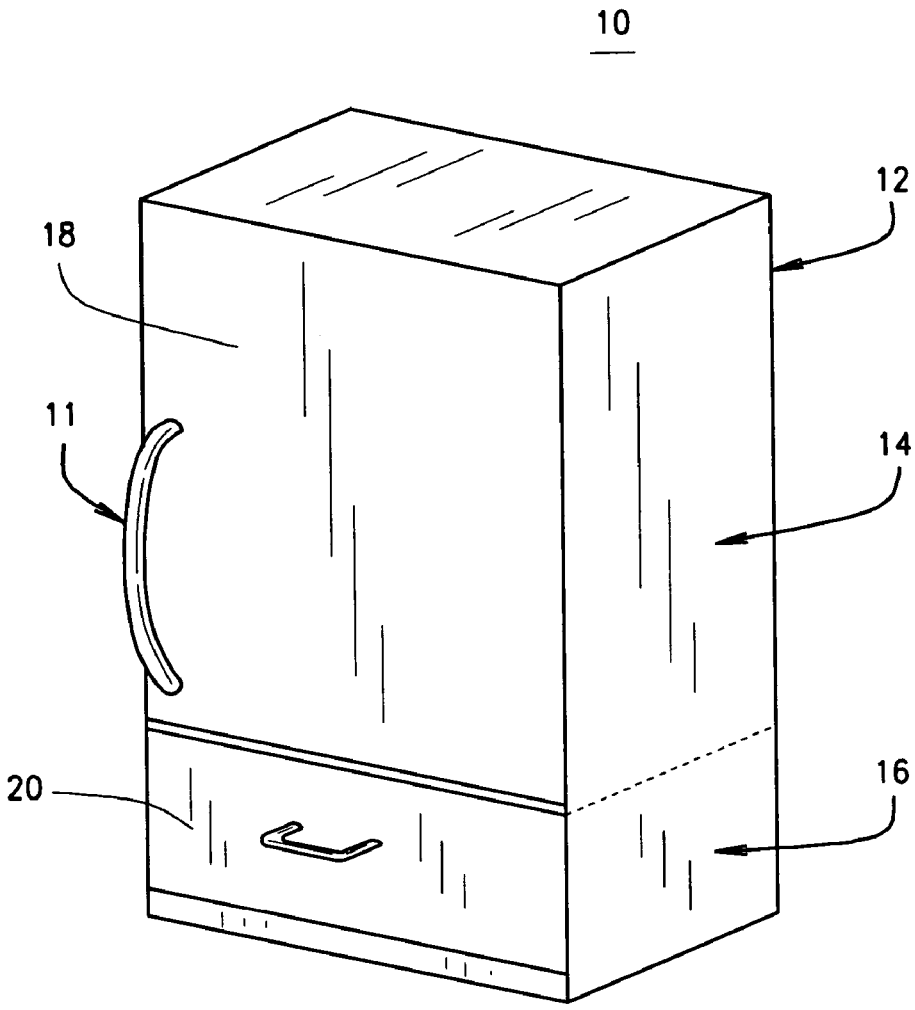
FIG. 1 is a perspective view of a refrigerator including an exemplary door handle assembly attached thereto.

FIG. 1 is a perspective view of a refrigerator 10 including an exemplary door handle assembly 11. Refrigerator 10 generally includes a housing 12 defining a fresh food compartment 14 and a freezer compartment 16. A fresh food door 18 is rotatably hinged to an edge of housing 12 for accessing fresh food compartment 14. A freezer door 20 is arranged for accessing freezer compartment 16. Handle assembly 11 is coupled to fresh food door 18 for opening operation. It is recognized, however, that the benefits of the present invention may be achieved in refrigerators having other configurations, such as a side by side configuration, or other home appliances, such as conventional ovens, microwave ovens, dishwashers, and the like. Consequently, the description set forth herein is for illustrative purposes only and is not intended to limit the invention.

Figure 2:
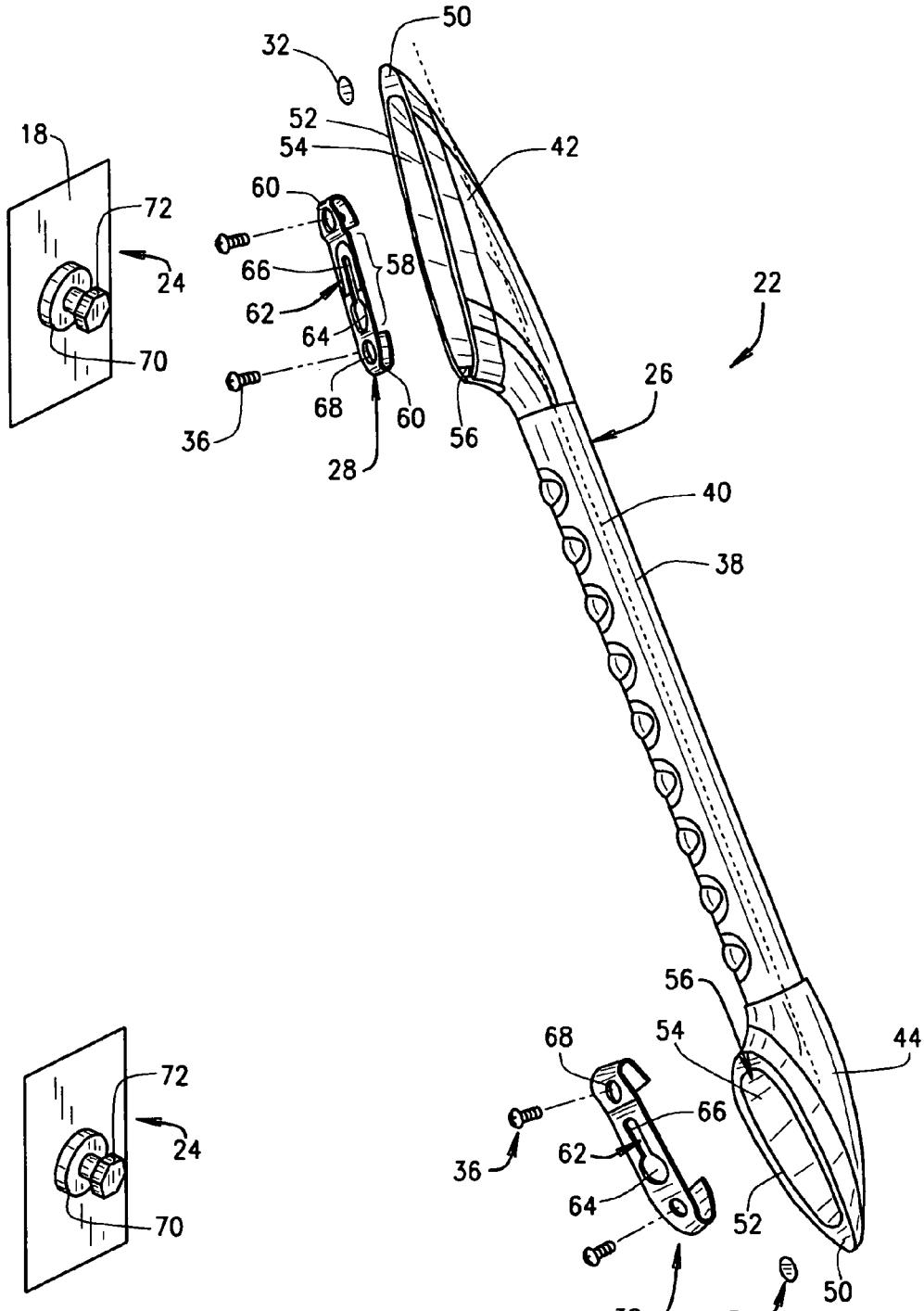
FIG. 2 is an exploded perspective view of the door handle assembly shown in FIG. 1 and mounting portions of a door of the refrigerator.

FIG. 2 is an exploded perspective view of door handle assembly 11 and mounting portions or fastening members 24 extending from refrigerator door 18. In the exemplary embodiment, door handle assembly 11 includes a handle body 26, a first latch member 28, a second latch member 30, a first protective member 32, and a second protective member 34. A plurality of fasteners 36 are utilized to couple latch members 28 and 30 to handle body 26.

In the exemplary embodiment, handle body 26 includes a grip portion 38 extending substantially along a longitudinal axis 40 between a first, or upper, attachment portion 42 and a second, or lower, attachment portion 44. Attachment portions 42 and 44 facilitate attaching respective first and second ends of handle body 26 to an exterior surface of fresh food door 18. In an alternative embodiment, handle assembly 11 includes a single attachment portion for attaching to door 18.

In the exemplary embodiment, each attachment portion 42 and 44 includes a mounting surface 50 and an exterior edge 52 for interfacing with door 18. The interface defined by mounting surface 50 and exterior edge 52 is substantially planar and extends substantially perpendicularly to longitudinal axis 40. Mounting surface 50 provides a flat area to mount protective members 32 and 34. In the exemplary embodiment, mounting surfaces 50 are provided at an upper edge of upper attachment portion 42 and at a lower edge of lower attachment portion 44. In an alternative embodiment, mounting surfaces 50 are provided at both upper and lower edges of each attachment portion 42 and 44. Additionally, a recess 54 is defined within each attachment portion 42 and 44 for receiving latch members 28 and 30. Each recess 54 is accessed through an opening 56 defined by exterior edge 52.

Latch members 28 and 30 each include a body 58 extending between attachment arms 60. In the exemplary embodiment, latch members 28 and 30 are fabricated from a metal material. Body 58 includes a ramp opening 62 for mating with mounting portions 24 extending from door 18. In the exemplary embodiment, ramp opening 62 has a bulbous shape including a first, or head, portion 64 that is wider than a second, or neck, portion 66. In one embodiment, second portion 66 is tapered such that, as the edges of ramp opening 62 engage mounting portions 24, latch member 28 or 30 is retained by mounting portion 24 in a friction fit. Moreover, attachment arms 60 are folded over to define a clip. Attachment arms 60 mate with attachment portions 42 and 44 within recesses 54. Each attachment arm 60 includes a mounting hole 68 for receiving a fastener 36 and for securing latch member 28 or 30 within recess 54.

In the exemplary embodiment, protective members 32 and 34 are fabricated from a low friction film, such as a poly-tetrafluoro-ethylene material. In the exemplary embodiment, protective members 32 and 34 have a thickness ranged from between approximately 0.003 inches to 0.008 inches. As such, once handle assembly 11 is installed, there is no perceptible gap between edges 52 of attachment portions 42 and 44 and the exterior surface of door 18.

Protective members 32 and 34 are coupled to respective mounting surfaces 50 to reduce, or substantially eliminate contact between handle body 26 and the exterior surface of fresh food door 18. Specifically, protective members 32 and 34 are coupled to mounting surfaces 50 of attachment portions 42 and 44 to facilitate reducing damage, such as damage from marring or scraping of the exterior surface of fresh food door 18 during installation and/or removal of handle body 26. In one embodiment, protective members 32 and 34 include an adhesive applied to one surface thereof. Protective members 32 and 34 are coupled to mounting surfaces 50 using adhesive. In an alternative embodiment, protective members 32 and 34 are additionally secured along edges 52 of attachment portions 42 and 44 to reduce damage caused by edges contacting the exterior of door 18.

In the exemplary embodiment, mounting portions 24 each include a mounting flange 70 extending outward from the exterior of refrigerator door 18 and defining a notch or ramp section 72 for retaining latch members 28 or 30 therein. Mounting portions 24 are coupled to refrigerator door 18 in a known manner. In one embodiment, mounting portions 24 are mounted to door 18 by a threaded portion (not shown). Ramp sections 72 are oriented to engage with ramp openings 62 of respective latch members 28 and 30. Specifically, during assembly, ramp openings 62 slidably engage ramp sections 72 to secure handle assembly 11 to door 18.

During assembly, latch members 28 and 30 are positioned within recess 54 of respective attachment portions 42 and 44. Fasteners 36 are inserted into mounting holes 68 of attachment arms 60 to secure latch members 28 and 30 to attachment portions 42 and 44. Next, protective members 32 and 34 are coupled to mounting surface 50 in a predetermined location to facilitate substantially eliminating damage to door 18 during assembly. In one embodiment, protective members 32 and 34 are coupled to mounting surface 50 using an adhesive applied to, for example, mounting surface 50 or protective members 32 and 34. Finally, handle assembly 11 is coupled to door 18 by coupling latch members 28 and 30 to mounting portions 24. Specifically, ramp openings 62 are placed over ramp sections 72 and handle assembly 11 is slid along door 18 to engage ramp sections 72. More specifically, as handle assembly 11 is slid along door 18, ramp section 72 becomes fully seated within neck portion 66 of opening 62 and handle assembly 11 is secured to refrigerator door 18.

Moreover, as explained above, protective members 32 and 34 are positioned to contact the exterior surface of door 18. As such, contact between attachment portions 42 and 44 and door 18 is substantially eliminated. Additionally, because protective members 32 and 34 are fabricated from a low friction film, protective members 32 and 34 facilitate reducing the force required to fully couple handle assembly 11 to door 18.

Figure 3:
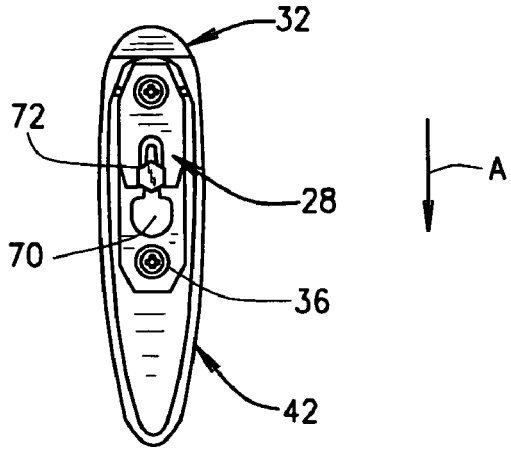
FIG. 3 is a front elevational view of a mounting portion of the door assembled with a latch member of the handle assembly shown in FIG. 2.

FIG. 3 is a front elevational view of mounting portion 24 assembled with latch member 28 of handle assembly 11. As illustrated in FIG. 3, latch member 28 is securely coupled to attachment portion 42 using fastener 36. During assembly, ramp opening 62 is positioned over mounting flange 70 such that ramp section 72 is aligned within neck portion 66 of opening 62. As handle assembly 11 (shown in FIGS. 1 and 2) is moved substantially vertically downward, such as in the direction of arrow A, ramp section 72 becomes fully seated within neck portion 66 and handle assembly 11 is secured to refrigerator door 18 (shown in FIGS. 1 and 2). Moreover, FIG. 3 illustrates an exemplary position of protective member 32 with respect to attachment portion 42. Specifically, protective member 32 is positioned along an upper edge of attachment portion 42.

The above described handle assembly is cost-effective and highly-reliable. The assembly includes handle attachment portions having latch members for engaging mounting portions of a refrigerator door. Specifically, the latch portions are slidably coupled to the mounting portions. In the exemplary embodiment, the handle assembly also includes protective members, such as low friction films, that may be applied to the attachment portions in predetermined locations. The protective members substantially eliminate damage to the door during installation of the handle assembly by providing a thin layer between the components. As such, scratching and marring of the door due to installation and removal of the handle assembly is reduced. Moreover, by placing the protective members only in predetermined locations, the handle assembly is fabricated in a cost effective manner. Additionally, because the protective members include a low friction film, the handle assembly is installed quickly and easily compared to conventional handle assemblies.

While the invention has been described in terms of various specific embodiments, those skilled in the art will recognize that the invention can be practiced with modification within the spirit and scope of the claims.

What is claimed is:

1. A door handle assembly comprising:

a handle body defining a longitudinal axis and comprising a first attachment portion proximate a first end of said handle body, said first attachment portion configured to engage a door panel, said first attachment portion comprising a first substantially planar interface configured to lie proximate the door panel with said first attachment portion engaged with the door panel, said first substantially planar interface comprising a first mounting surface and a first circumferentially extending exterior edge forming a rim;

a first latch member removably coupled to said first attachment portion via one or more fasteners, said first latch member configured to attach said first attachment portion to the door panel, said first latch member defining a first ramp opening having a neck portion and a head portion, said first ramp opening defining an axis of symmetry parallel to and coplanar with the longitudinal axis, said neck portion configured to engage a first corresponding mounting portion extending from the door panel; and a first protective member coupled to said first mounting surface, said first protective member sized to fit within and not beyond the rim of said first circumferentially extending exterior edge, said first protective member facilitates reducing damage to the door panel during installation of said door handle assembly to the door panel.

2. A door handle assembly in accordance with claim 1 further comprising a second attachment portion at an opposing second end of said handle body, a second latch member coupled to said second attachment portion, and a second protective member, said second attachment portion comprises a second substantially planar interface configured to lie proximate the door panel with said second attachment portion engaged with the door panel, said second substantially planar interface comprises a second mounting surface and a second circumferentially extending exterior edge forming a rim, said second latch member defining a second ramp opening that is parallel to the longitudinal axis and aligned with said first ramp opening, said second protective member coupled to said second mounting surface, and said second protective member sized to fit within the rim of said second circumferentially extending exterior edge.

3. A door handle assembly in accordance with claim 1 wherein said circumferentially extending exterior edge defines a recess within said first attachment portion, said first latch member is positioned within said recess such that said circumferentially extending exterior edge of said handle body is oriented adjacent the door panel when said handle body is attached thereto.

4. A door handle assembly in accordance with claim 1 wherein said first protective member is fabricated from a low friction film.

5. A door handle assembly in accordance with claim 1 wherein said first protective member is fabricated from a poly-tetra-fluoro-ethylene material.

6. A door handle assembly in accordance with claim 1 wherein said first protective member has a thickness of about 0.003 inches to about 0.008 inches.

7. A door handle assembly in accordance with claim 1 wherein said first protective member facilitates reducing marring of the door panel during installation and removal of said handle body.

8. A door handle assembly in accordance with claim 1 wherein said first protective member facilitates reducing an attachment force for attaching said handle body to the door panel.

9. A door handle assembly in accordance with claim 1 wherein said first latch member comprises an opening for receiving a portion of the door panel and securing said door handle assembly to the door panel.

10. A door handle assembly in accordance with claim 1 wherein said neck portion is tapered to facilitate engagement with the corresponding mounting portion.

11. A door handle assembly in accordance with claim 1 wherein said neck portion is configured to receive a ramp section of the corresponding mounting portion to facilitate securing said door handle assembly to the door panel.

* * * * *